US005105659A

United States Patent [19]

Ayoub

[11] Patent Number: 5,105,659

[45] Date of Patent: Apr. 21, 1992

[54] DETECTION OF FRACTURING EVENTS USING DERIVATIVES OF FRACTURING PRESSURES

[75] Inventor: Joseph A. Ayoub, Houston, Tex.

[73] Assignee: Dowell Schlumberger Incorporated, Tulsa, Okla.

[21] Appl. No.: 585,000

[22] Filed: Sep. 19, 1990

[51] Int. Cl.[5] ..... E21B 47/10

[52] U.S. Cl. ..... 73/155; 166/250

[58] Field of Search ..... 73/155; 166/250, 308, 166/281

[56] References Cited

U.S. PATENT DOCUMENTS 4,192,182 3/1980 Sylvester ..... 73/155

4,393,933 7/1983 Nolte et al. ..... 166/250

*Primary Examiner*—Jerry W. Myracle

*Attorney, Agent, or Firm*—Stephen A. Littlefield

[57] ABSTRACT

In accordance with illustrative embodiments of the present invention, a method of determining fracture behavior from downhole pressure measurements that are made during a hydraulic well fracturing operation includes pumping fracturing fluids at a constant rate under high pressure against a formation to create fractures therein, and obtaining measurements representative of downhole pressures as pumping progresses. The logarithmic derivatives of such pressure measurements are used to determine the type of fracture behavior, as well as the onset of screenout where the fracturing fluid carries a proppant. In-situ stress or closure pressure also can be determined by finding a value thereof which makes a logarithmic net pressure plot have the same slope as the logarithmic plot of the values of the pressure derivatives.

24 Claims, 3 Drawing Sheets

DETECTION OF FRACTURING EVENTS USING DERIVATIVES OF FRACTURING PRESSURES

FIELD OF THE INVENTION

This invention relates generally to the analysis of pressure data that is obtained during injection of fracturing fluids into an earth formation in order to determine fracture behavior and events, and particularly to a new and improved method that involves use of the logarithmic derivative of such pressures to determine minimum in-situ stress or closure pressure, and to identify fracturing events such as extension of the fractures with confined height or with height growth, and to provide early detection of screenout.

BACKGROUND OF THE INVENTION

The oil and gas products that are contained, for example, in sandstone earth formations, occupy pore spaces in the rock. The pore spaces are more or less interconnected to define permeability, which is a measure of the ability of the rock to transmit fluid flow. If permeability is low, or when some damage has been done to the formation material immediately surrounding the bore hole during the drilling process, a hydraulic fracturing operation can be performed to increase the production from the well.

Hydraulic fracturing is a process where a fluid under high pressure is applied against the formation to split the rock and create fractures that penetrate deeply into the formation. The fractures provide additional flow channels, as well as more surface area through which formation fluids can flow into the well bore. The result is to improve the near term productivity of the well, as well as its ultimate productivity, by providing flow channels that extend farther into the formation. Most wells of this type are fractured upon initial completion, and are refractured at a later date to restore productivity To prevent healing of the fractures after the parting pressure is released, it has become conventional practice to use propping agents of various kinds to hold the cracks open, and spacer materials to ensure optimum distribution of the proppants.

During fracturing, fluids are injected into the formation at a given rate in order to initiate the fractures and then propagate them. Calibrations can be made to determine key design parameters, or propping agent treatments. The efficiency of fracturing treatments rely heavily on the ability to produce fractures that have optimum physical characteristics such as length, height, width and flow capacity. Such characteristics can be predetermined to some extent by using a reservoir model, together with certain selected economic criteria. A determination of the closure pressure, and the identification of fracturing events such as height growth and/or the occurrence of screenout (proppant bridging that restricts fracture extension), in a timely manner, is crucial to the economic success of a fracturing operation, and to any future operations in the same geographical area by appropriate modification of the design criteria.

It is known that fracture behavior and certain fracturing events cause characteristic changes or patterns of change, in downhole pressures. As an aid to pressure change pattern recognition from which a model that defines the fracturing process can be inferred, it is known in the art to plot net pressure values versus pumping time on a log-log scale, where net pressure is the difference between bottom hole pressure and the in-situ stress or fracture closure pressure. See Nolte and Smith U.S. Pat. No. 4,393,933 issued Jul. 19, 1983, and "Interpretation of Fracturing Pressures", Nolte and Smith, *Journal of Petroleum Technology* Sep. 1981, p. 1767. A low, positive slope for this net pressure plot indicates so-called "PKN" behavior where the fracture is one that penetrates deeply into the formation with height confinement. A low, negative slope of the plot indicates "KGD" behavior where fracture height is much larger than its penetration into the formation, and can also indicate a radial or a penny-shaped fracture. A portion of the plot that has a substantially flat slope is indicative of the opening of natural fissures in the rock and accelerated fluid leakoff. This phenomenon may result in "screenout", which, as mentioned above, is a condition where propping agents bridge the fracture and restrict further extension thereof. Screenout itself is characterized by a section of the plot that has a relatively high positive slope of about one, or even higher. The net pressure plot has served as a very useful pattern recognition tool for interpreting fracturing pressure data, and enables a diagnosis to be made of certain fracturing events.

However, the use of the net pressure plot depends upon the existence of certain input data which can be ill-defined. The time origin is when the fracture is initiated, which usually is taken to be the time at which the gelled fluids hit the formation. The slopes exhibited by the net pressure plot depend to some extent on the value of the closure pressure, which has to be measured independently, preferably using in-situ stress tests. Failure to have the actual closure pressure can result in an inaccurate slope of the plot. A net pressure plot with a small positive slope may appear to be flat if the closure pressure that was selected is too low, and vice versa. Consequently an inaccurate interpretation of fracture behavior can be made if the error is not detected. In addition, certain important fracturing events can be difficult to detect in a timely manner due to compression of the data that is imposed by a logarithmic scale. Thus, there remains the need to enhance pattern recognition techniques in a manner that will obviate the foregoing limitations, and enhance the sensitivity of the analysis.

The general object of the present invention is to provide a new and improved method of analyzing the pressure data during a well fracturing operation that enhances early identification of certain fracturing events, such as extension of a fracture with confined height, or with height growth, as well as early detection of the onset of screenout.

Another object of the present invention is to provide a new and improved method of analyzing pressure data during a well fracturing operation that enable a more accurate determination of minimum in-situ stress or closure pressure.

SUMMARY OF THE INVENTION

These and other objects are attained in accordance With the concepts of the present invention through the performance of methods comprising the steps of pumping a fracturing fluid, preferably at a constant rate into a formation to create fractures in the rock, measuring the downhole pressures during such pumping step, determining the logarithmic derivative of the pressure data, plotting such derivative on a log-log scale as a function of time elapsed after initiation of a fracture, and determining the type of fracture and its propagation characterization from the general shape and slope of certain portions of the plot. Minimum in-situ stress can be determined by choosing a closure pressure value which, when subtracted from the fracture pressures yields a straight line on the plot having the same slope as the derivative plot for two dimensional and radial fractures. It can be demonstrated that the derivative is unaffected by the value of the closure pressure that is actually used, so that the effects of using an inaccurate closure pressure in a net pressure plot are eliminated. Indeed, the slope obtained from the derivative plot can be used directly to estimate the correct closure pressure. Where the fracturing fluid carries a propping agent, the derivative plot also has a characteristic slope which is indicative of an actual or potential screenout, which is evident much earlier in time than with the use of prior interpretation techniques.

BRIEF DESCRIPTION OF THE DRAWINGS

The present invention has other objects, features and advantages which will become more clearly apparent in connection with the following detailed description of preferred methods, taken in conjunction with the appended drawings in which.

DETAILED DESCRIPTION OF PREFERRED EMBODIMENTS

Figure 1:
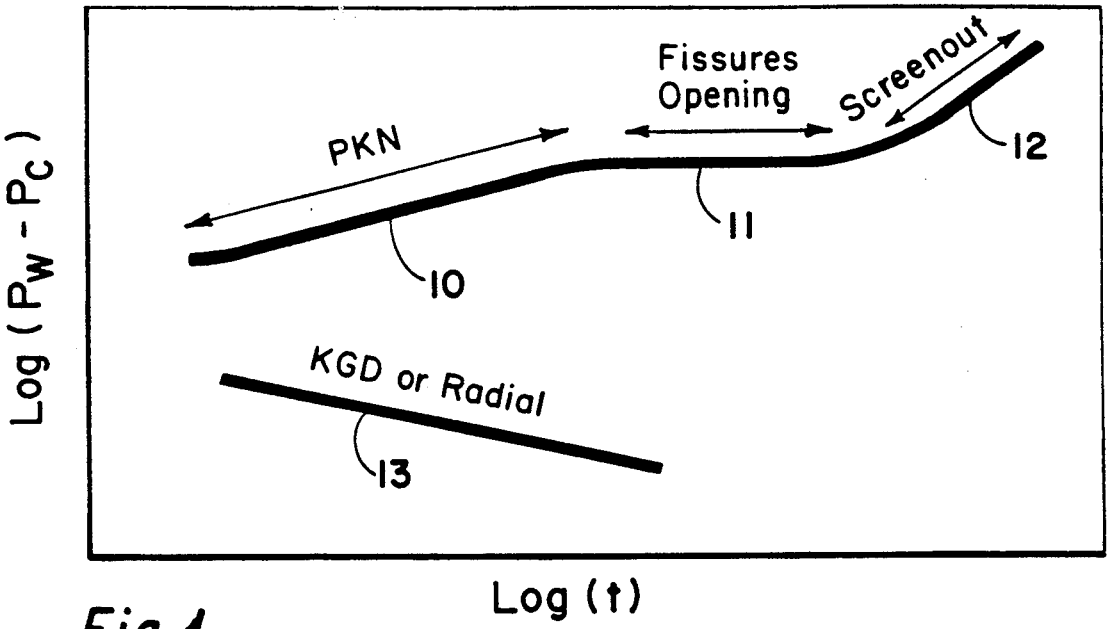
Fig. 1 (PRIOR ART)
FIG. 1 is an illustration of a log-log net pressure plot showing various types of fracture behavior and certain fracturing events.

FIG. 1 illustrates a generalized "net pressure" plot of downhole well bore pressures vs. pumping time on a log-log scale. The ordinates of the plot represent the differences between bottom hole pressure and in-situ stress or closure pressure of the rock, and the abscissae values represent elapsed pumping time. The curve portion 10 having a constant positive slope is indicative of "PKN" behavior of a fracture where it extends outwardly into the rock with vertical height confinement. The curve portion 11 which has a substantially flat slope indicates opening of natural fissures in the rock and accelerated leakoff of fracturing fluid, or stable height growth into a barrier. Curve portion 12, which has a positive slope of about one (1), is indicative of the onset of a "screenout" where bridging of a fracture by proppants will restrict further fracture extension. Curve 13 having a constant negative slope shows "KGD" type of behavior of a fracture where the height is greater than the penetration distance of the fracture into the formation, or a radial, penny-shaped fracture. The plots shown in FIG. 1 are the so-called "net pressure" plots and are well known in the art as a diagnostic tool for interpretation of fracturing pressure data. The pressure data can be measured during the fracturing operation in any suitable manner, for example by use of a downhole pressure gauge, or a dead string for measuring surface pressures that are representative of downhole conditions. The pressures also can be inferred from surface measurements of injection pressures, taking into account the friction losses in the pipe, and the hydrostatic head pressure. Thus, the term "measuring" as used herein and in the claims is intended to encompass any procedure whereby the pressure data is obtained.

The basic relationship for the PKN, and the KGD or radial fracture geometrics shown in FIG. 1 can be written as:

$$Pw - Pc = At^b \tag{1}$$

Where

A = constant of proportionality
Pw = pressure in the well bore, psi
Pc = closure pressure, psi
t = time since initiation of fracture, min.
b = slope Taking the derivative of Equation (1) yields:

$$\frac{d(Pw - Pc)}{dt} = \frac{dPw}{dt} = Abt^{b-1} \tag{2}$$

Multiplying Equation (2) through by t gives:

$$t\frac{dPw}{dt} = Abt^b \tag{3}$$

Figure 2:
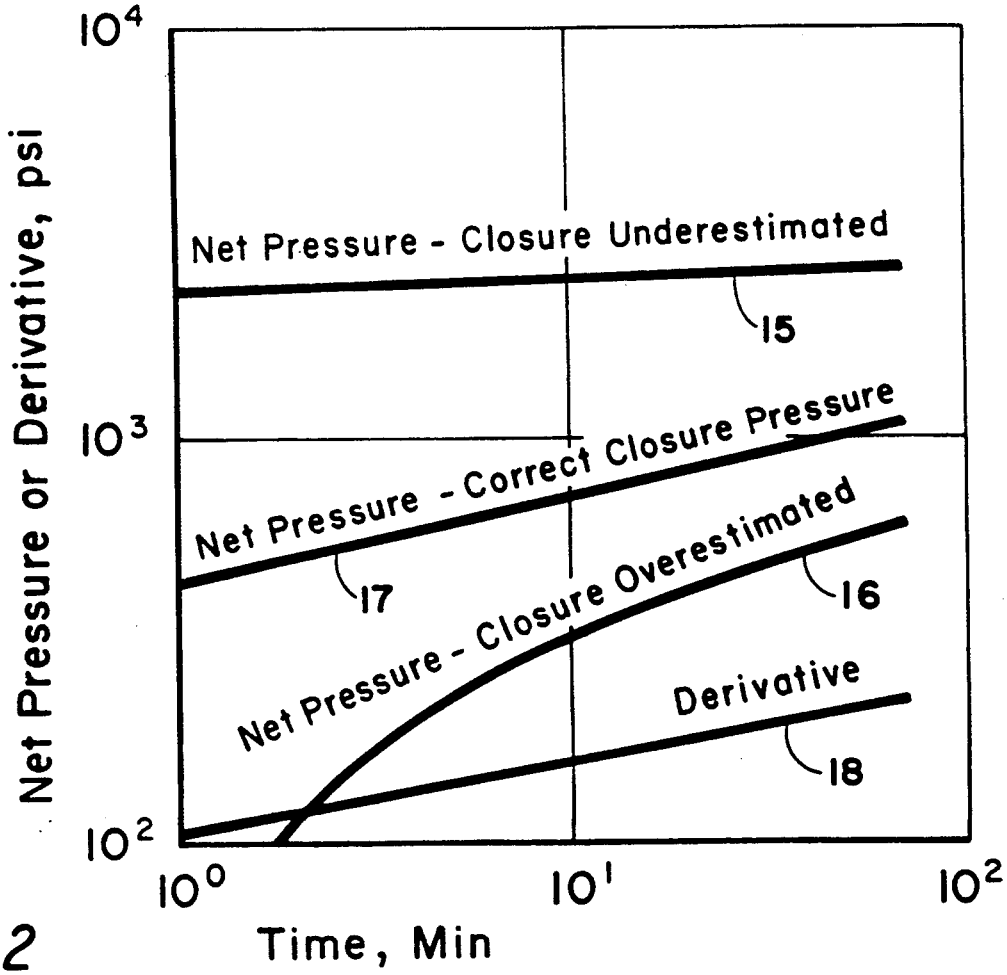
FIG. 2 is a log-log plot of the derivative of the pressure values and several net pressure plots, to illustrate how the correct closure pressure value can be determined.

It therefore follows that a log-log plot of the left-hand side of equation (3) versus pumping time will yield the same slope b as in equation (1), the net pressure plot. However, knowledge of the actual closure pressure, which essentially is constant is not necessary. In the absence of an independent measurement of the closure pressure, the slope of the derivative values can be used to estimate closure pressure by finding the value that will yield an equal slope for the corresponding net pressure plot. This effect is illustrated in FIG. 2 where curve 15 will result if closure pressure is underestimated, curve 16 will result if closure pressure is overestimated, and curve 17 which is parallel to the derivative plot 18 will result where the estimated closure pressure value is correct. It can be seen from FIG. 2 that an incorrect value for the closure pressure has a significant effect on the net pressure plot, while the derivative stays the same. The effect of constant friction losses in the casing or tubing also are eliminated, since the derivative is a measure of rate of change.

Provided the fracture is propagating with height confinement, or radially, the logarithmic derivative values of the pressure will display a straight line 18 having a slope of a certain value. As noted above, the minimum in-situ stress can then be determined by choosing a closure pressure value that, when subtracted from the fracture pressures, yields a log-log straight line 17 of equal slope. It will be apparent that the use of derivative values in accordance with this invention makes the choice of the closure pressure value that is actually used unimportant, since the derivative is unaffected thereby.

Fracture extension with height confinement (PKN behavior) can be readily identified from the plot according to the present invention, and is characterized by the net pressure plot 17 and the derivative plot 18 displaying parallel straight lines that have a small positive slope, generally between ¼ and ⅛. Parallel straight lines with a small negative slope indicates either fracture height confinement for a height greater than three (3) times its penetration distance into the formation, or a radial, penny-shaped fracture. A flat derivative, that is where the slope approaches zero, indicates a stable height growth through a barrier, or possibly natural fissures that are opening and thereby accelerating leakoff.

Figure 3:
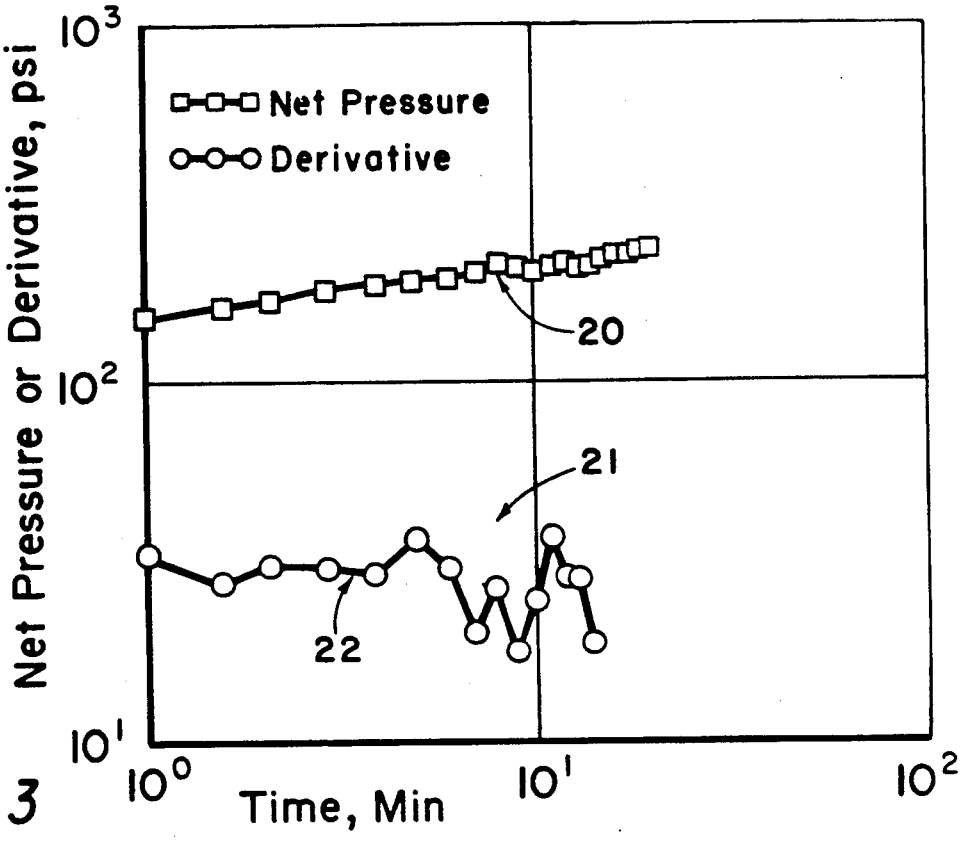
FIG. 3 is a log-log plot of both net pressure and the derivative that illustrates detection of stable height growth.

FIG. 3 illustrates the foregoing effect and shows that the net pressure plot 20, alone, would have suggested fracture extension with height confinement. However the derivative plot 21, being approximately constant, shows clearly that a stable height growth, or fissures opening, is in fact taking place. The recognition of this through use of the present invention is important, as it gives a clear and early warning that the pressure capacity of the formation may be reached during the fracturing operation which will result in inefficient fracture extension, and a possible screenout, which would have a detrimental effect on the economics of the well unless corrective action is taken once the behavior is recognized from the essentially flat portion 21 of the derivative plot.

Figure 4:
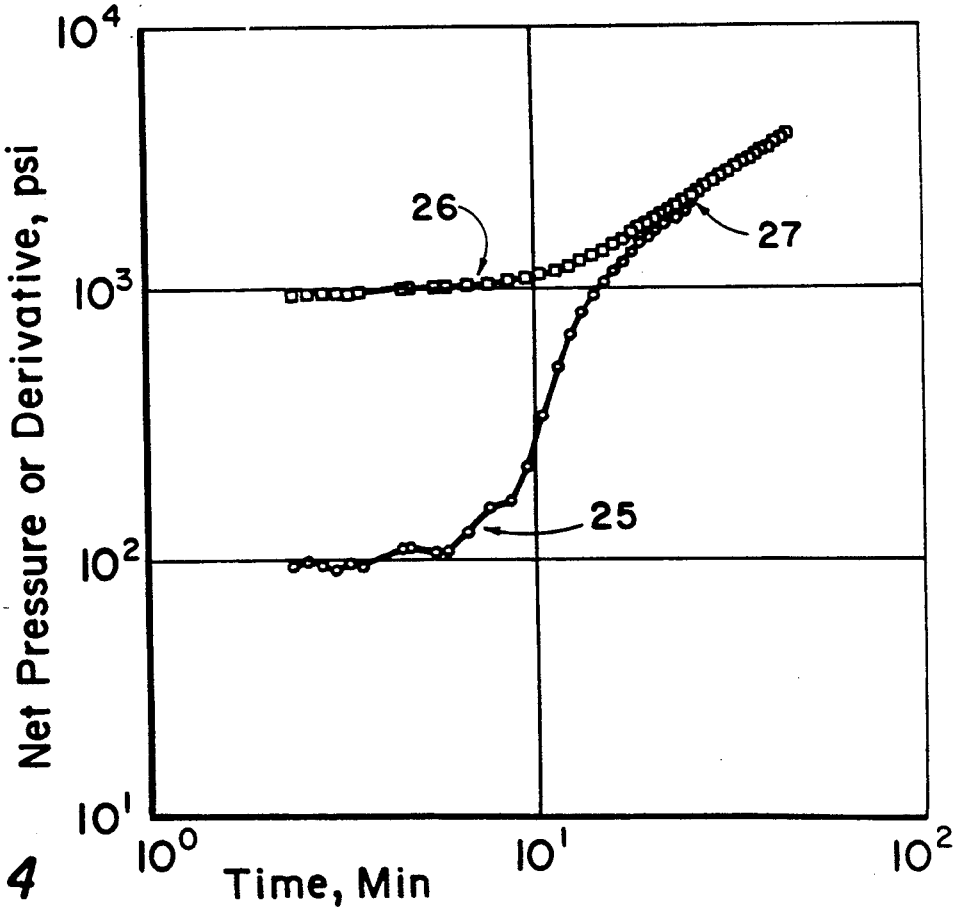
FIG. 4 is a plot similar to FIG. 3 of both net pressure and the derivative that illustrates early detection of a fracture tip-type screenout.
Figure 5:
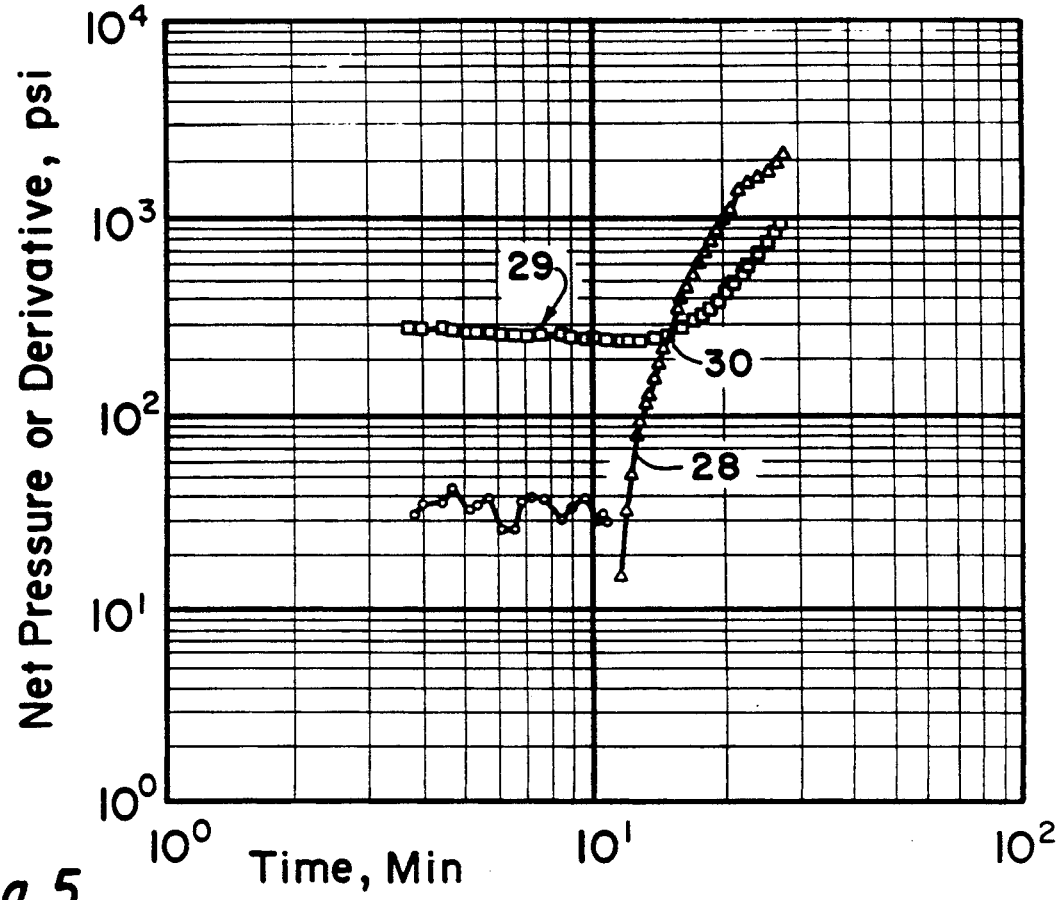
FIG. 5 is a plot similar to FIG. 4 which is diagnostic of a near well bore screenout.

Another important fracturing event that can be recognized early in accordance with the present invention is screenout. The use of the derivative provides enhanced sensitivity, and detects events earlier in time than is possible through the use of the net pressure plot alone. As shown in FIG. 4, a fracture tip screenout can be recognized when the derivative increases sharply in the curve portion 25, well before this phenomena can be observed on the net pressure plot 26. At a later time, the derivative and net pressure values tend to merge in the region 27. For a near well bore screenout, FIG. 5 shows that the derivative increases sharply in the region 28, and then crosses the net pressure plot 29 at 30, which again identifies the screenout earlier than by using the net pressure plot alone. The lead time obtained in accordance with the present invention is highly advantageous in that corrective actions can be taken to minimize the economic impact of a screenout.

Figure 6:
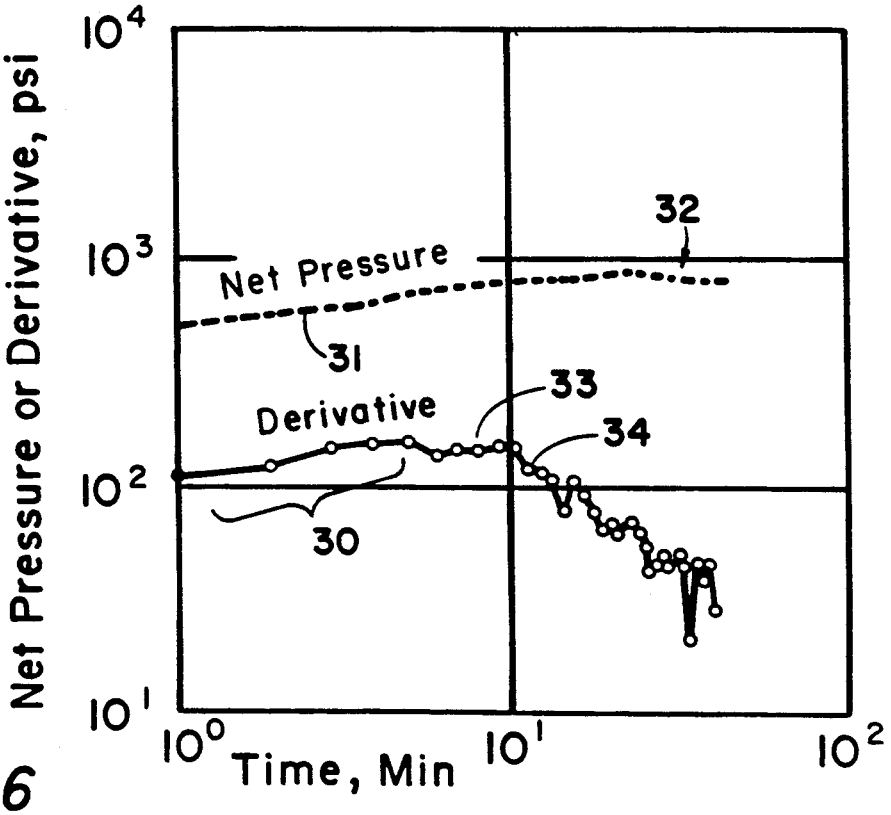
FIG. 6 is a log-log plot of net pressure and the pressure derivative taken from actual field data.

The use of the derivative of the pressure data clearly magnifies and permits detection of events earlier in time than prior methods due to the enhanced sensitivity. To further illustrate the derivative approach, a diagnostic plot is shown in FIG. 6 of net pressure, and the pressure derivative, made from actual field data. The plot indicates "PKN" behavior of the fractures in the region 30 of the plot for about the first six (6) minutes of pumping. The closure pressure is determined by making the slope of the net pressure data in the PKN region equal to that of the plot of the derivatives. The estimate was found to coincide with the results of an in-situ stress test that was conducted prior to the job. The net pressure data exhibits a flattened aspect 32 that is evident after about 20 minutes of pumping, while the injection rate was maintained constant. This pattern indicates increased fluid loss due to opening of natural fissures in the rock, or stable height growth. The pressure at which this phenomenon occurs its known as the pressure capacity of the formation. Detection of such capacity is crucial for an adequate design of a fracturing operation. Pressures are then kept, if possible, below the critical value which would otherwise increase leakoff, decrease the efficiency of fracture extension, and possibly result in an early screenout by premature slurry dehydration. Of extreme importance in connection with the present invention is the fact that the derivative detects the departure from the PKN-type behavior earlier in time. For example the derivative slope flattens in the region 33 after about 7 minutes, and a definite downward trend 34 can be seen at about 12 minutes. This lead time can be used to great advantage in making on-the-spot decisions during the fracturing operation.

The plots as disclosed herein can be made by machine in real time upon receipt of downhole pressure measurements, and then an interpretation made in accordance with the present invention upon observation of the trends of such plots. Alternatively, the interpretation also can be made by machine computation with a suitable display of the diagnosis. Either procedure is intended to be within the scope of the present invention.

It now will be recognized that new and improved methods have been disclosed for analysis of the pressure data that is obtained during a well fracturing operation. As mentioned previously, the data can be obtained by direct downhole measurements, or can be inferred from surface measurements, taken together with other factors such as friction losses and hydrostatic head. Since certain changes or modifications may be made in the disclosed methods without departing from the inventive concepts involved, it is the aim of the appended claims to cover all such changes or modifications falling within the true spirit and scope of the present invention.

What is claimed is:

1. A method of analyzing pressure data obtained during a well fracturing operation to determine fracture behavior, comprising the steps of: pumping fracturing fluid under pressure into a formation to thereby fracture the formation; obtaining measurements of pressures in the wellbore at various points in time during said pumping step; and determining the type of fracture behavior from the rates of change of said pressures at a plurality of said points in time.

2. The method of claim 1 wherein said determining step includes detecting that a fracture is extending outwardly into the formation with height confinement when said rates of change increase in a substantially constant manner.

3. The method of claim 1 wherein said determining step includes detecting increased fluid loss from a fracture due to opening of natural fissures in the rock when said rates of change remain substantially the same.

4. The method of claim 1 wherein said determining step includes detecting stable height growth of a fracture when said rates of change remain substantially the same.

5. The method of claim 1 wherein said determining step includes detecting that the height of a fracture is much larger than its penetration distance into the formation, or that the fracture is forming radially, when said rates of change decrease in a substantially constant manner.

6. The method of claim 1 when said determining step include detecting the onset of a screenout of a fracture when said rates of change increase at a slope of at least about one.

7. A method of determining the minimum in-situ stress or closure pressure tending to close a fracture from pressure data that is obtained during a hydraulic fracturing operation, comprising the steps of: pumping a fracturing fluid under pressure into a formation to thereby fracture the formation; obtaining measurements representative of downhole pressures during said pumping step; and determining said closure pressure by finding a value of the same that, when deducted from the said pressure measurements, causes the rates of change of the differences between said pressure measurements and said closure pressure at a plurality of points during said pumping time to be substantially the same as the rates of change of the derivative of said pressure measurements at said plurality of points during said pumping time.

8. A method of analyzing pressure data obtained during a well fracturing operation, comprising the steps of: pumping a fracturing fluid under pressure into a formation to thereby fracture the formation; measuring downhole pressures at various points in time during said pumping step; making a plot of the derivative of said pressures versus pumping time on a log-log scale; and using the slope of said plot to determine fracture behavior.

9. The method of claim 8 including the step of determining that a fracture is extending outwardly into the formation with height confinement when a portion of said plot has a substantially constant positive slope.

10. The method of claim 8 including the step of determining increased fluid loss from a fracture due to opening of natural fissures in the rock when a portion of said plot is substantially flat.

11. The method of claim 8 including the step of determining stable, moderate height growth of a fracture when a portion of said plot is substantially flat.

12. The method of claim 8 including the step of determining that the height of a fracture is much larger than its penetration distance into the formation, or that the fracture is radial, when a portion of said plot has a substantially constant negative slope.

13. The method of claim 8 including the step of determining the onset of a screenout of a fracture when a portion of said plot has a positive slope of at least about one.

14. A method of determining the minimum in-situ stress or closure pressure of a formation from pressure data that is obtained in a well bore during a hydraulic fracturing operation, comprising the steps of: pumping a fracturing fluid under pressure into a formation to thereby fracture the formation; measuring downhole pressures during said pumping step; determining the derivatives of said pressures at various points in time during said pumping step; determining the differences between such pressures and an estimated closure pressure; and determining a corrected closure pressure by adjusting the value of said estimated closure pressure until the rate of change of said differences is substantially equal to the rate of change of said derivatives.

15. The method of claim 14 wherein said step of determining a corrected closure pressure includes the steps of making a first plot of said derivatives on a log-log scale, making a second plot of said differences on said scale, and comparing the slope of said second plot to the slope of said first plot.

16. A method that enables early detection of the event of extension of a fracture with height confinement during a formation fracturing operation, comprising the steps of: pumping a fracturing fluid under pressure into a formation to fracture the same; measuring downhole pressures during said pumping step; determining the derivatives of said pressures at a plurality of points in time during said pumping step; determining the differences between said pressures and the closure pressure of the formation; and detecting fracture extension with height confinement when the respective rates of change of said derivatives and said differences are substantially equal and have a relatively low positive value.

17. The method of claim 16 wherein said detecting step includes the steps of making a first plot of said derivatives on a log-log scale, making a second plot of said differences on said scale, and comparing the slope of said second plot to the slope of said first plot.

18. The method of claim 17 wherein said value of said slopes is in the range of about 0.125 to 0.25.

19. A method that enables early detection of the onset of a screenout at the tip of a fracture during a formation fracturing operation, comprising the steps of: pumping a fracturing fluid containing a proppant material into a formation to thereby fracture the formatik.n; measuring downhole pressures during said pumping step; determining the derivatives of said pressures at a plurality of points in time during said pumping step; determining the differences between such pressures and fracture closure pressure; and detecting the onset of a fracture tip screenout when the respective rates of change of said derivatives and said differences are such that the trends of the values thereof tend to merge.

20. The method of claim 19 wherein said detecting step includes the steps of making a first plot of said derivatives on a log-log scale, making a second plot of said differences on said scale, and comparing said second plot to said first plot for a tendency of said plots to merge toward one another.

21. A method that enables early detection of the onset of a near - well bore screenout of a fracture during a formation fracturing operation, comprising the steps of; pumping a fracturing fluid carrying a proppant material into a formation to thereby fracture the formation; measuring the pressures of said fracturing fluids downhole during said pumping step; determining the derivatives of said pressures at a plurality of points in time during said pumping step; determining the differences between said pressures and fracture closure pressure; and detecting the onset of a near-well bore screenout where the respective rates of change of said derivatives and said differences are such that the trends of the values thereof tend to cross one another.

22. The method of claim 21 wherein said detecting step includes the steps of making a first plot of said derivatives on a log-log scale, making a second plot of said differences on said scale, and comparing said second plot to said first plot for a tendency of said plots to cross one another.

23. A method of determining the pressure capacity of a formation from pressure data that is obtained in a well bore during a hydraulic fracturing operation, comprising the steps of: pumping a fracturing fluid under pressure into a formation to fracture the same; measuring downhole pressures during said pumping step; determining the derivatives of said pressures at a plurality of points in time during said pumping step; and detecting the value of said pressure capacity when the rate of change of said derivatives changes from being a small, positive value to a substantially zero value.

24. The method of claim 23 where said detecting step includes the steps of plotting the values of said derivatives on a log-log scale, and comparing the progressive values of the slope of said plot for said change from a value in the range of between 0.125 and 0.25, to a value that is substantially zero.

* * * * *